United States Patent [19]

Morchin

[11] Patent Number: 4,779,097

[45] Date of Patent: Oct. 18, 1988

[54] SEGMENTED PHASED ARRAY ANTENNA SYSTEM WITH MECHANICALLY MOVABLE SEGMENTS

[75] Inventor: William C. Morchin, Auburn, Wash.

[73] Assignee: The Boeing Company, Seattle, Wash.

[21] Appl. No.: 781,931

[22] Filed: Sep. 30, 1985

[51] Int. Cl.[4] ..... H01Q 3/22; H01Q 3/24

[52] U.S. Cl. ..... 342/368; 342/375; 342/157; 343/705; 343/757; 343/758

[58] Field of Search ..... 343/705, 757, 757 E, 343/758, 766, 882; 342/371, 368, 372, 375, 354, 427, 434, 437, 157, 158

[56] References Cited

U.S. PATENT DOCUMENTS

| | | | |
|---|---|---|---|
| 1,711,745 | 5/1929 | Pearne | 455/274 |
| 2,078,302 | 4/1937 | Wolff | 455/106 |
| 2,190,717 | 2/1940 | Kümmich et al. | 342/440 |
| 2,405,242 | 8/1946 | Southworth | 343/882 |
| 2,434,253 | 1/1948 | Beck | 343/763 |
| 2,534,451 | 12/1950 | Kahan et al. | 343/882 |
| 2,573,401 | 10/1951 | Carter | 343/882 |
| 2,605,413 | 7/1952 | Alvarez | 343/815 |
| 2,644,158 | 6/1953 | Thrift | 342/430 |
| 3,699,574 | 10/1972 | O'Hara et al. | 343/705 X |
| 3,864,689 | 2/1975 | Young | 343/705 X |
| 3,974,462 | 8/1976 | Fassett | 333/116 X |
| 4,129,866 | 12/1978 | Turco | 342/158 |

FOREIGN PATENT DOCUMENTS

| | | | |
|---|---|---|---|
| 2040018 | 2/1972 | Fed. Rep. of Germany | 343/757 |
| 0040063 | 3/1979 | Japan | 343/757 |
| 136190 | 10/1979 | Japan | 342/368 |

OTHER PUBLICATIONS

Frank, J.; "Discrete-Beam Phased Array"; *Microwave Journal;* Oct. 1977; pp. 31-34.

Skolnik et al; Radar Handbook; Chapter 11-45, FIG. 31.

Eli Brookner, "Phased-Array Radars", Scientific American, vol. 252, No. 2, pp. 94-102, Feb. 1985.

*Primary Examiner*—Eugene R. LaRoche
*Assistant Examiner*—Benny T. Lee
*Attorney, Agent, or Firm*—Christensen, O'Connor, Johnson & Kindness

[57] ABSTRACT

A segmented phased array antenna system for scanning two different ranges of directions with a single set of antenna elements. The system comprises a plurality of segments (40), each of which has a plurality of antenna elements (48) mounted therein. The segments are mounted by support means (42, 44, 46) such that each segment is movable between first and second positions. In each set of positions, the antenna elements are operated as a conventional phased array radar system. The antenna system may be longitudinally mounted along the upper surface of the fuselage of an airplane (10) to provide side-looking radar coverage to both sides of the airplane.

16 Claims, 4 Drawing Sheets

SEGMENTED PHASED ARRAY ANTENNA SYSTEM WITH MECHANICALLY MOVABLE SEGMENTS

FIELD OF THE INVENTION

The present invention relates to phased array antenna systems. Such antenna systems find particular application in phased array radars.

BACKGROUND OF THE INVENTION

In a typical phased array radar, a plurality of antenna elements are arranged in a plane, and a microwave signal of a selected frequency is fed to each antenna element. Each antenna element responds by radiating at the selected frequency. When the antenna elements radiate synchronously and inphase with one another, the radiation from the several antenna elements constructively interferes along a boresight direction normal to the planar array, and destructively interferes along other directions, thereby producing a narrow beam directed along the boresight direction. By introducing prescribed phase and/or time delays in the feed paths to the respective antenna elements, the beam can be electronically steered to angles up to about 60° from the boresight direction. For two-dimensional arrays, the steering can be accomplished in two perpendicular directions normal to the boresight.

In one common application, a phased array antenna is mounted in the nose of a plane, and used to scan a cone of forward directions. For certain applications, however, it is necessary to scan a range of directions wider than that which can be scanned using a single, fixed phased array antenna. In the past, wider scanning ranges have been accomplished either by providing plural phased array antennas, or by physically rotating the entire array of antenna elements. The former approach has a disadvantage of doubling the weight and cost associated with the antennas. The latter approach is impractical in many situations, due to the size of the array and to space and/or aerodynamic considerations.

SUMMARY OF THE INVENTION

The present invention provides a phased array antenna system, such as for a phased array radar, in which two different ranges of directions can be scanned using a single set of antenna elements.

In a preferred embodiment, the phased array antenna system comprises a plurality of antenna segments, each segment having a plurality of antenna elements mounted therein. The segments are mounted by support means such that each segment is movable between first and second positions. Electromagnetic radiation is fed to each antenna element along a feed path, and feed means are provided to introduce phase or time delays in each feed path, such that when the segments are in their respective first positions, the antenna system can transmit and receive electromagnetic radiation along a first range of directions, and such that when the segments are in their respective second positions, the antenna system can transmit and receive electromagnetic radiation along a second range of directions different from the first range of directions. In one application, the phased array antenna system extends longitudinally along the upper surface of the fuselage of an airplane, and the first and second ranges of directions are laterally disposed on opposite sides of the airplane. Phase shifters for the antenna elements may be mounted within the respective movable segments.

DETAILED DESCRIPTION OF THE INVENTION

Figure 1:
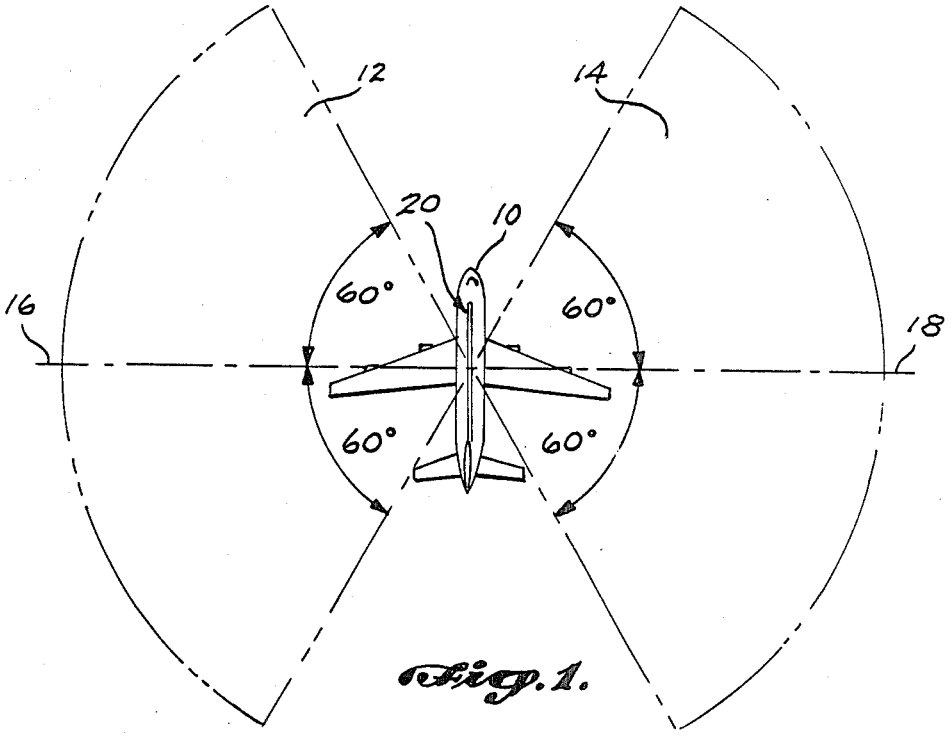
FIG. 1 is a schematic view showing an airplane having radar coverage to either side of the plane.

An important application of the present invention is in radar systems for airplanes, and in particular in airplanes that require side-looking radar. FIG. 1 is a top plan view of airplane 10 that includes lateral radar coverage according to the present invention. The radar coverage includes a first range 12 of directions to one side of the airplane, and a corresponding second range 14 to the opposite side of the airplane. Range 12 may extend 60° to either side of boresight direction 16, and range 14 similarly may extend 60° to either side of boresight direction 18. Boresight directions 16 and 18 are antiparallel to one another and perpendicular to the longitudinal axis of airplane 10. Ranges 12 and 14 also extend vertically into and out of the plane of the drawing in FIG. 1.

Figure 2:
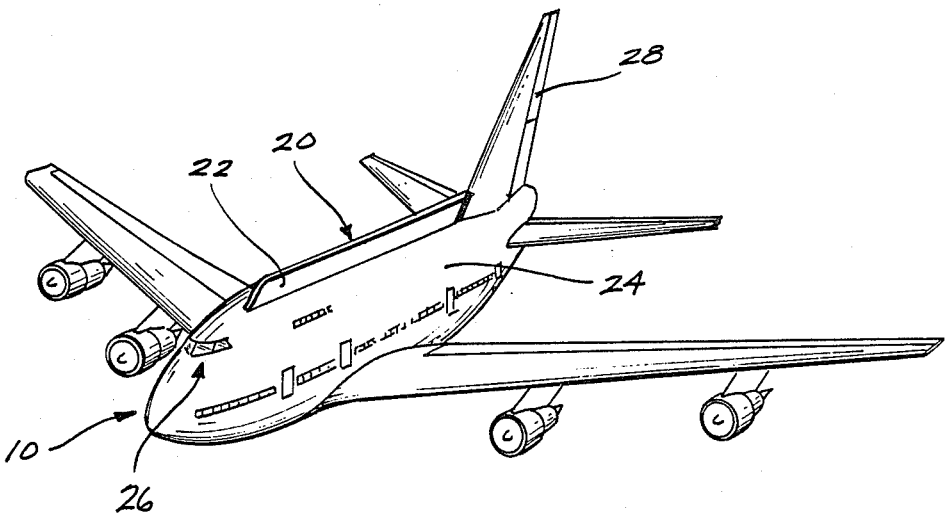
FIG. 2 is a perspective view of an airplane including an antenna system according to the present invention.

The radar coverage illustrated in FIG. 1 is achieved, according to the present invention, by a phased array radar system that includes antenna system 20 (FIG. 2). Antenna system 20 comprises a blade-like shell or radome 22 centrally positioned on the upper surface of the fuselage 24 of airplane 10, and extending along the longitudinal axis of the airplane from near cockpit windows 26 to adjacent tail 28. The individual antenna elements are mounted within shell 22. In accordance with the present invention, the two-sided coverage illustrated in FIG. 1 is achieved using a single set of antenna elements by mounting the antenna elements on a plurality of movable segments.

Figure 3:
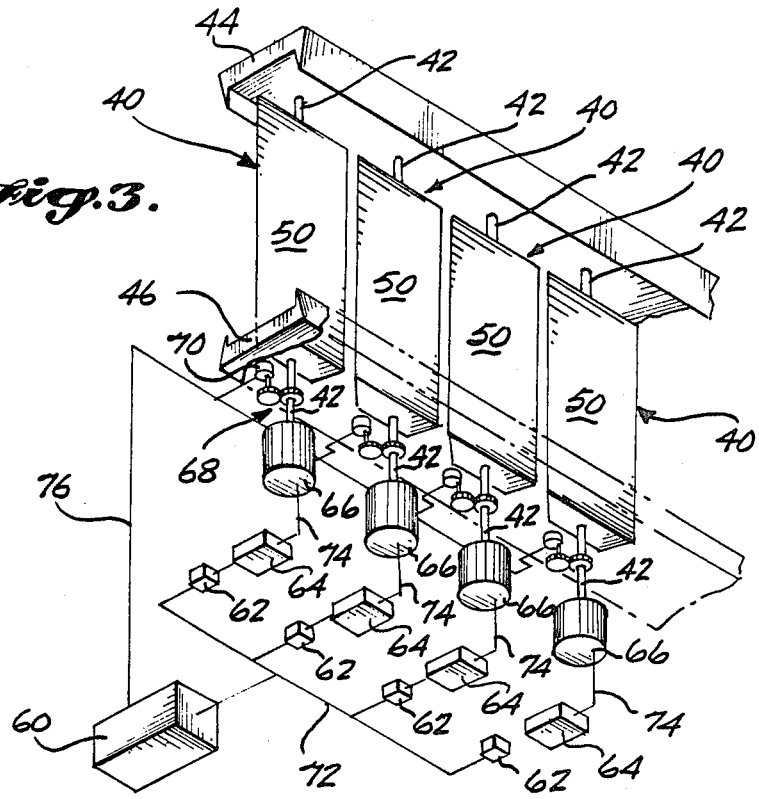
FIG. 3 is a schematic perspective view of the antenna system.
Figure 4:
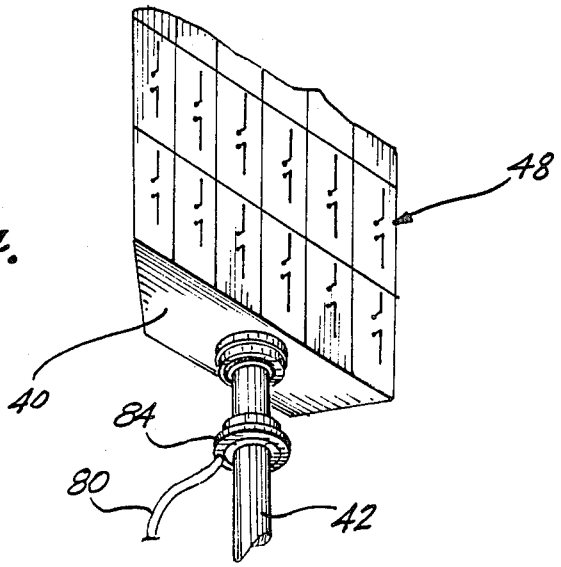
FIG. 4 is a partial perspective view of one segment of the antenna.

Referring now to FIGS. 3 and 4, antenna system 20 comprises a plurality of segments 40 that are mounted by respective shafts 42, each shaft being mounted between upper beam 44 and lower beam 46 by suitable bearings (not shown). The assembly comprising segments 40 and the upper and lower beams is mounted within shell 22 (FIG. 2). Each segment 40 comprises a rectangular array of antenna elements 48 (FIG. 4). Each antenna element may comprise a dipole antenna, a slotted antenna or any other radiating element useable in a phased array antenna system. The antenna elements of each segment are positioned in a plane such that the antenna elements define a radiating face 50 for each segment.

Each shaft 42 together with its associated segment 40 can be rotated about the longitudinal axis of the shaft. The shafts are parallel to one another and lie in a common plane that extends between upper beam 44 and lower beam 46 parallel to the longitudinal axis of airplane 10. The shafts are spaced apart along beams 44 and 46 such that when the radiating faces are parallel to and coplanar with one another (as in FIG. 3), the lateral edges of adjacent segments are closely spaced from one another. When the radiating faces are so positioned, the antenna elements of all the segments can be operated as a single, conventional phased array antenna system that scans a range of angles, such as range 12 of FIG. 1. When it is desired to scan a range in a different direction such as range 14, each segment is rotated 180° about the longitudinal axis of the associated shaft, and the antenna elements are again operated as a conventional phased array radar system to scan range 14. In each case, boresight directions 16 and 18 are defined by the outwardly directed normal to radiating faces 50. To scan ranges other than ranges 12 and 14, the segments may be rotated through angles other than 180°, to provide an array of antenna elements in which radiating faces 50 are parallel to one another but not coplanar with one another.

Other elements of the phased array radar system shown in FIG. 3 include control system 60, digital-to-analog converters 62, amplifiers 64, servo motors 66, gear assemblies 68 and digital potentiometers 70. Control system 60 provides digital signals on bus 72 representing the desired rotational positions of the segments. Such signals are input to digital-to-analog converters 62, and the digital-to-analog converters produce corresponding analog signals that are input to amplifiers 64. The amplifiers amplify the analog signals to produce servo drive signals on lines 74 that are input to the respective servo motors 66. Servo motors 66 are coupled directly to shafts 42, and each servo motor rotates its respective shaft to the position specified by the respective control signal on line 74. The rotational position of each shaft, and therefore of each segment, is picked off by digital potentiometers 70 through gear assemblies 68, and the digital potentiometers produce digital signals on bus 76 that indicate the respective segment positions. The digital position signals on line 76 are returned to control system 60, and used by the control system to update the signals on line 72. The control system may be adapted to respond to a segment position command entered manually by an operator or provided automatically by a radar system.

Figure 5:
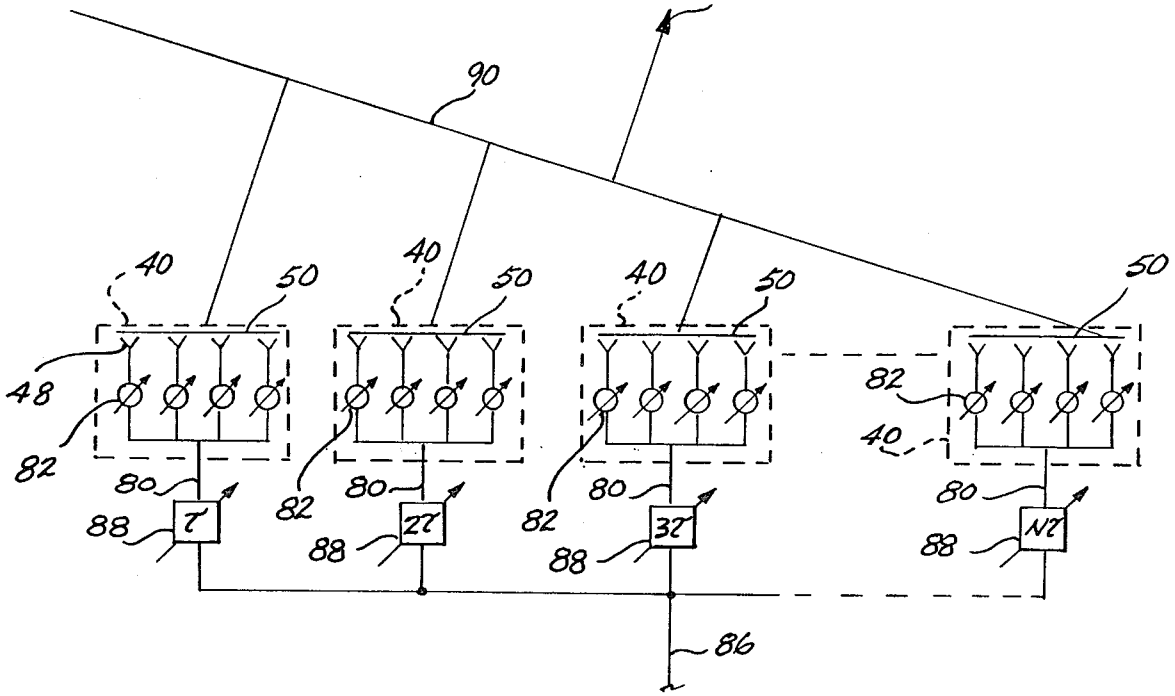
FIG. 5 is a schematic view of the antenna system with all radiating faces coplanar; and, FIG. 6 is a schematic view of the antenna system with the radiating faces parallel but not coplanar.

FIG. 5 sets forth a schematic view of a simplified phased array radar system according to the present invention. In FIG. 5, each segment 40 is shown as comprising four antenna elements 48. A microwave signal is provided to each segment 40 through cables 80, the signal on cable 80 being coupled to each antenna element 48 through phase shifters 82. The phase shifters are physically mounted within the respective segments. The signal on line 80 may be coupled to each segment through a slip-ring arrangement 84 (FIG. 4) arranged about shaft 42. The signals on cables 80 are derived from a source signal on cable 86 through a plurality of time delay circuits 88. Time delay circuit 88 and phase delay circuits 82 operate in a conventional manner, under the control of the radar system, to produce radiation having equiphase front 90, to produce an electronically steered radar beam directed along direction 92. Signals for controlling the phase shifters are provided to the segments by conventional means (not shown) such as flexible cables.

Figure 6:
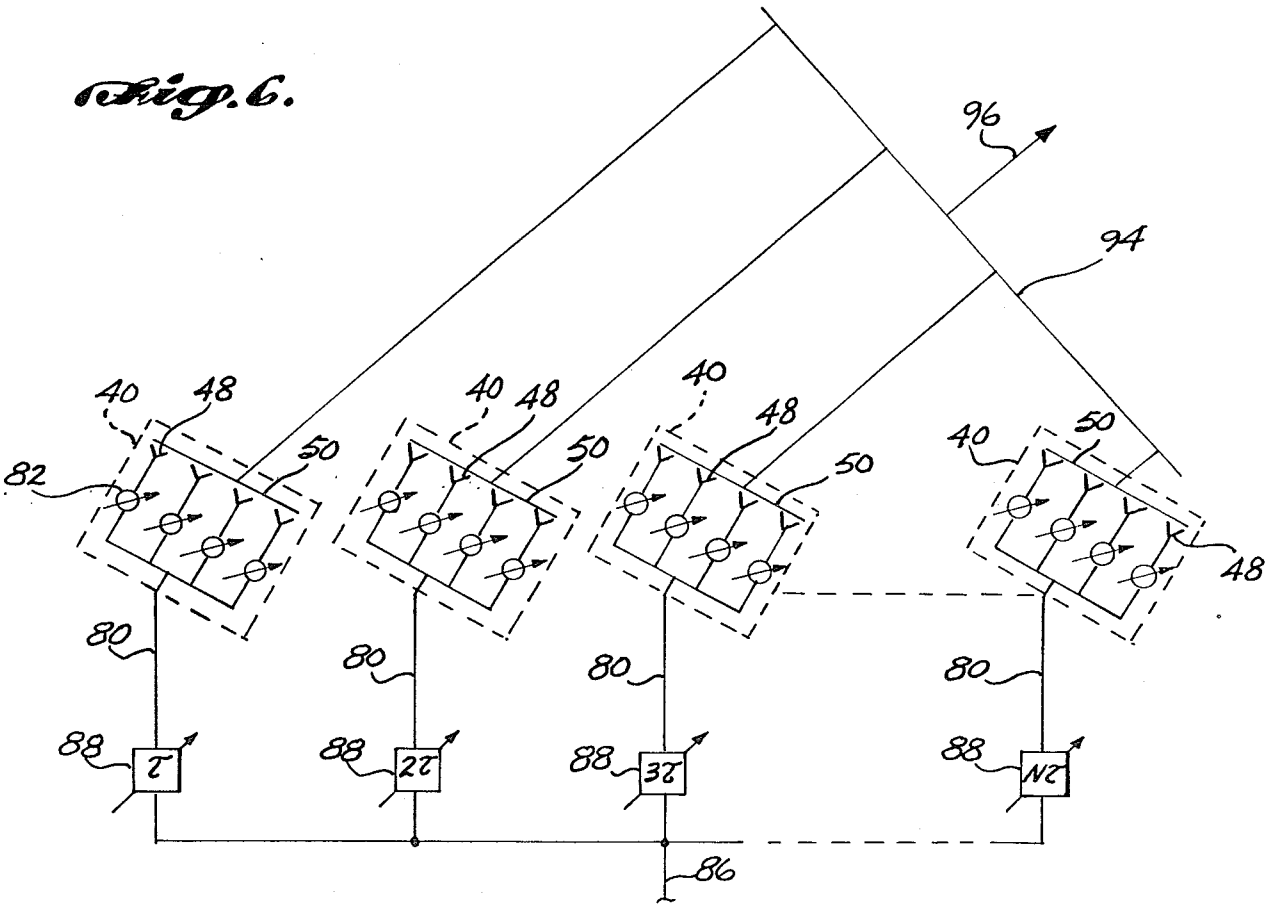

FIG. 6 illustrates an alternate arrangement in which segments 40 are rotated at an angle other than ±180° from their coplanar positions. In this configuration, radiating faces 50 are parallel to one another although not coplanar, and the phase and time delays are adjusted to produce equiphase front 94 and a beam of radiation in direction 96. In the configuration shown in FIG. 6, it may be desirable in some applications to provide for electrical continuity between the radiating faces of adjacent segments, to avoid unwanted reflection.

While the preferred embodiments of the invention have been illustrated and described, it is to be understood that other variations will be apparent to those skilled in the art. For example, one group of segments could be positioned as in FIG. 3 such that these segments were rotatable leftward and rightward to scan ranges in a lateral direction, and a second group of segments could be positioned with their rotational axes oriented 90° to the rotational axes of the first group of segments, to scan upward and downward. In other possible arrangements, the segments could be positioned such that their radiating faces were not coplanar but instead defined a curved (e.g., cylindrical) surface rather than a planar surface. Accordingly, the invention is not to be limited to the specific embodiments illustrated and described, and the scope and spirit of the present invention are to be determined by reference to the following claims.

The embodiments of the invention in which an exclusive property or privilege is claimed are defined as follows:

1. A phased array antenna system, comprising:

a plurality of antenna segments, each segment comprising a plurality of antenna elements mounted therein;

support means including means for mounting the segments such that each segment is rotatable about an associated axis between respective first and second positions, said associated axis about which each segment is rotatable being parallel to said associated axis of each of the other said segments and spaced apart from the axes of said other segments in a direction normal to said axes; and, phased array feed means for feeding electromagnetic radiation along a feed path to and from each antenna element, the feed means including means for providing phase or time delays to the electromagnetic radiation in each feed path, such that when the segments are in their respective first positions, the antenna system can transmit and receive electromagnetic radiation along a first range of directions, and such that when the segments are in their respective second positions, the antenna system can transmit and receive electromagnetic radiation along a second range of directions different from the first range of directions.

2. The antenna system of claim 1, wherein the antenna elements of each segment are positioned in a respective plane so as to define a radiating face for the segment, and wherein the radiating faces of the segments are parallel to one another when the segments are in their respective first positions and when the segments are in their respective second positions.

3. The antenna system of claim 2, wherein the first range of directions includes a first boresight direction normal to the radiating faces when the segments are in their respective first positions, and wherein the second range of directions includes a second boresight direction normal to the radiating faces when the segments are in their respective second positions.

4. The antenna system of claim 3, wherein the first and second boresight directions are antiparellel to one another.

5. The antenna system of claim 4, wherein the radiating faces are coplanar when the segments are in their respective first positions and when the segments are in their respective second positions.

6. The antenna system of claim 1, wherein the support means comprises a plurality of shafts, each of said shafts having a longitudinal axis, each segment being mounted to a separate one of said shafts, each shaft and segment mounted to said shaft being rotatable about the longitudinal axis of said shaft.

7. The antenna system of claim 6, wherein the longitudinal axes of the shafts are parallel to one another and spaced apart from one another in a direction normal to the longitudinal axes of the shafts and lie in a common plane.

8. The antenna system of claim 7, wherein the segments are positioned along the upper surface of the fuselage of an airplane.

9. The antenna system of claim 7, wherein the antenna elements of each segment are positioned in a respective plane so as to define a radiating face for the segment, and wherein the radiating faces of the segments are parallel to one another when the segments are in their respective first positions and when the segments are in their respective second positions.

10. The antenna system of claim 9, wherein the first range of directions includes a first boresight direction normal to the radiating faces when the segments are in their respective first positions, and wherein the second range of directions includes a second boresight direction antiparallel to the first boresight direction and normal to the radiating faces when the segments are in their respective second positions.

11. The antenna system of claim 10, wherein the radiating faces are coplanar when the segments are in their respective first positions and when the segments are in their respective second positions.

12. The antenna system of claim 11, wherein the segments are positioned along the upper surface of the fuselage of an airplane, and wherein the first and second boresight directions are normal to the longitudinal axis of the airplane which runs centrally along the fuselage from the nose section to the tail section of said airplane.

13. The antenna system of claim 1, wherein the feed means comprises a phase shifter for each antenna element, the phase shifter for each antenna element being mounted in the respective segment.

14. The antenna system of claim 1, wherein each segment is rotatable through 360° about said associated axis.

15. The antenna system of claim 14, wherein said respective first and second positions include a plurality of said respective first positions and a plurality of said respective second positions, such that the antenna system can transmit and receive said electromagnetic radiation along a plurality of first ranges of directions and a plurality of second ranges of directions.

16. The antenna system of claim 15, wherein said plurality of first ranges and said plurality of second ranges of directions provide a 360° range of directions.

* * * * *